US006427468B1

(12) United States Patent
Topper et al.

(10) Patent No.: US 6,427,468 B1
(45) Date of Patent: Aug. 6, 2002

(54) FROST SHIELD FOR REFRIGERATED CABINET

(75) Inventors: Robert T. Topper, Herber Springs; Ronald E. Luyet, Conway, both of AR (US)

(73) Assignee: Tyler Refrigeration Corporation, Niles, MI (US)

( * ) Notice: Subject to any disclaimer, the term of this patent is extended or adjusted under 35 U.S.C. 154(b) by 0 days.

(21) Appl. No.: 09/639,467

(22) Filed: Aug. 15, 2000

(51) Int. Cl.[7] ..... F25D 21/00
(52) U.S. Cl. ..... 62/272; 62/283; 62/248
(58) Field of Search ..... 62/283, 248, 272

(56) References Cited

U.S. PATENT DOCUMENTS 3,858,408 A * 1/1975 Kenyon ..... 62/283
4,781,031 A * 11/1988 McElvany ..... 62/255
4,818,043 A * 4/1989 Borgen ..... 312/138
4,940,297 A * 7/1990 Borgen ..... 312/138.1
5,339,643 A * 8/1994 Pikaart ..... 62/80
5,428,968 A * 7/1995 Tetsukawa et al. ..... 62/248
5,449,885 A * 9/1995 Vandecastele ..... 219/522
6,141,984 A * 11/2000 Perzon et al. ..... 62/275

* cited by examiner

*Primary Examiner*—William C. Doerrler
*Assistant Examiner*—Mark Shulman
(74) *Attorney, Agent, or Firm*—William W. Habelt

(57) ABSTRACT

A plurality of frost shields (50) are removably positioned about the upper circumferential expanse of the walls of the liner (20) of a refrigerated cabinet (10). The frost shields (50) are magnetically mountable to the liner (20) to facilitate ease of installation and removal. Each frost shield (50) is a pliable panel fabricated in a layered construction with a relatively thin observe layer (52) of vinyl mounted on nominally thicker back layer of thermoplastic material (54) impregnated with magnetic material (60). Each frost shield (50) may be provided with a pair of handles (70) inserted in their respective slots (58) formed through the frost shield panel.

6 Claims, 2 Drawing Sheets

FROST SHIELD FOR REFRIGERATED CABINET

BACKGROUND OF THE INVENTION

The present invention relates generally to refrigerated cabinets of the type used in commercial application for housing frozen food products. More specifically, the present invention relates to frost shields for such refrigerated cabinets and, most particularly, to removable frost shields for ice cream dipping cabinets of the type covered by a canopy having a service door.

Refrigerated cabinets are used in commercial installations, such as supermarkets, gas station shops, convenience stores, ice cream shops and the like, for housing frozen food products. One common type of refrigerated cabinet has a open top to provide the customer easy access to frozen foods housed within the cabinet. Cabinets of this type are commonly used in supermarkets for displaying frozen vegetables, frozen juices, packaged ice cream products and the other frozen food products.

Another common refrigerated cabinet has a top canopy having a front window portion on the customer side of the cabinet through which the customer may view the product within the cabinet and a service door, conventionally of either the hinged or sliding type, on the rear, that is server side, of the cabinet. Refrigerated cabinets of this type are commonly used as ice cream dipping cabinets in ice cream shops, but also are used in many other food product display applications in supermarkets and other stores.

In low temperature refrigerated cabinets housing frozen food products, frost commonly forms on the upper portion of the interior walls, i.e. the liner, of the cabinet, particularly above the product fill line. Customarily, the product fill line is several inches below the top edge of the liner as an open volume filled with cold refrigerated air must be provided over the top of the frozen product to protect the product from the warm ambient air in the store. In operation, a certain amount of moist, warm ambient air will inevitably enter the cabinet from the store either through an open top or open service door. Frost formation occurs when this moist, warm air contacts the cold wall of the liner, particularly the upper portion of the liner encompassing the open volume above the food product. Excessive frost formation forms an undesirable insulating barrier between the cold refrigerated surface of the liner and the interior volume of the cabinet. In addition to being unsightly to customers, this frost formation often also reduces heat transfer efficiency and interferes with proper circulation of refrigerated air over the frozen product within the cabinet. As a result, excessive frost formation means increased operating costs.

Frost formation is particularly problematic in ice cream dipping cabinets. Such cabinets typically include a canopy disposed over cabinet base wherein the frozen confection to be served, for example not only ice cream, but also frozen yogurt, sherbet, sorbet and the like, is displayed. Customers can view the product through a window provided in the customer side of the canopy. The individual serving the customer accesses the frozen confection for scooping through a service opening provided in the server side of the canopy. A cover, typically either a hinged lid or a pair of sliding doors, provides for closing the service opening when access is not being made to the interior of the canopied cabinet.

As the service cover is frequently opened during the day to serve customers, frost typically forms rather quickly resulting in the need to defrost the cabinet. As the first step in defrosting an ice cream dipping cabinet, all product must be removed and transferred to another freezer. Once the product is removed from the cabinet, the refrigeration system is shut down and the frost removed either by passing warm air into or spraying warm water on the cabinet interior to melt the frost or by manually scraping the frost from the walls. Obviously, the defrost process is cumbersome and time consuming.

In U.S. Pat. No. 3,858,408, Andre J. Kenyon discloses a refrigerated cabinet having a plurality of detachable frost shields, comprising substantially planar panels, mounted to the upper portion of the liner on the cabinet. In operation, frost forms primarily on the frost shield rather than directly on the liner itself. To defrost the cabinet, the frost shields are removed from the cabinet and the frost thereon readily removed, typically by contacting the frost with hot water. The frost shields are then reinstalled. The disclosed frost shields consist of, generally, of a metallic construction covered with an acrylic enamel finish which is said to provide a sanitary, durable and easy to clean surface. The panels include mounting means at intermittent points along the panel that engage studs extending outwardly from the liner surface. The presence of these studs on the liner surface complicates cleaning of the liner surface and can provide an area where undesirable bacterial growth may establish a foothold resulting in a potentially unsanitary environment.

SUMMARY OF THE INVENTION

It is an object of the present invention to provide an improved detachable frost shield.

It is a further object of a particular aspect of the present invention to provide a pliable frost shield that adheres to the contour of the refrigerated surface via magnetic attraction.

It is a further object of another aspect of the present invention to provide a frost shield that may be easily detached, cleaned and reinstalled.

The frost shield of the present invention comprises a pliable panel fabricated in a layered construction with a relatively thin observe layer of vinyl mounted on nominally thicker back layer of thermoplastic material impregnated throughout with magnetic material, most advantageously a ferrite powder. To facilitate installation and removal, the panel may be provided with handles.

BRIEF DESCRIPTION OF THE DRAWINGS

The present invention will be described herein with reference to the drawing wherein.

DETAILED DESCRIPTION OF A PREFERRED EMBODIMENT

Figure 1:
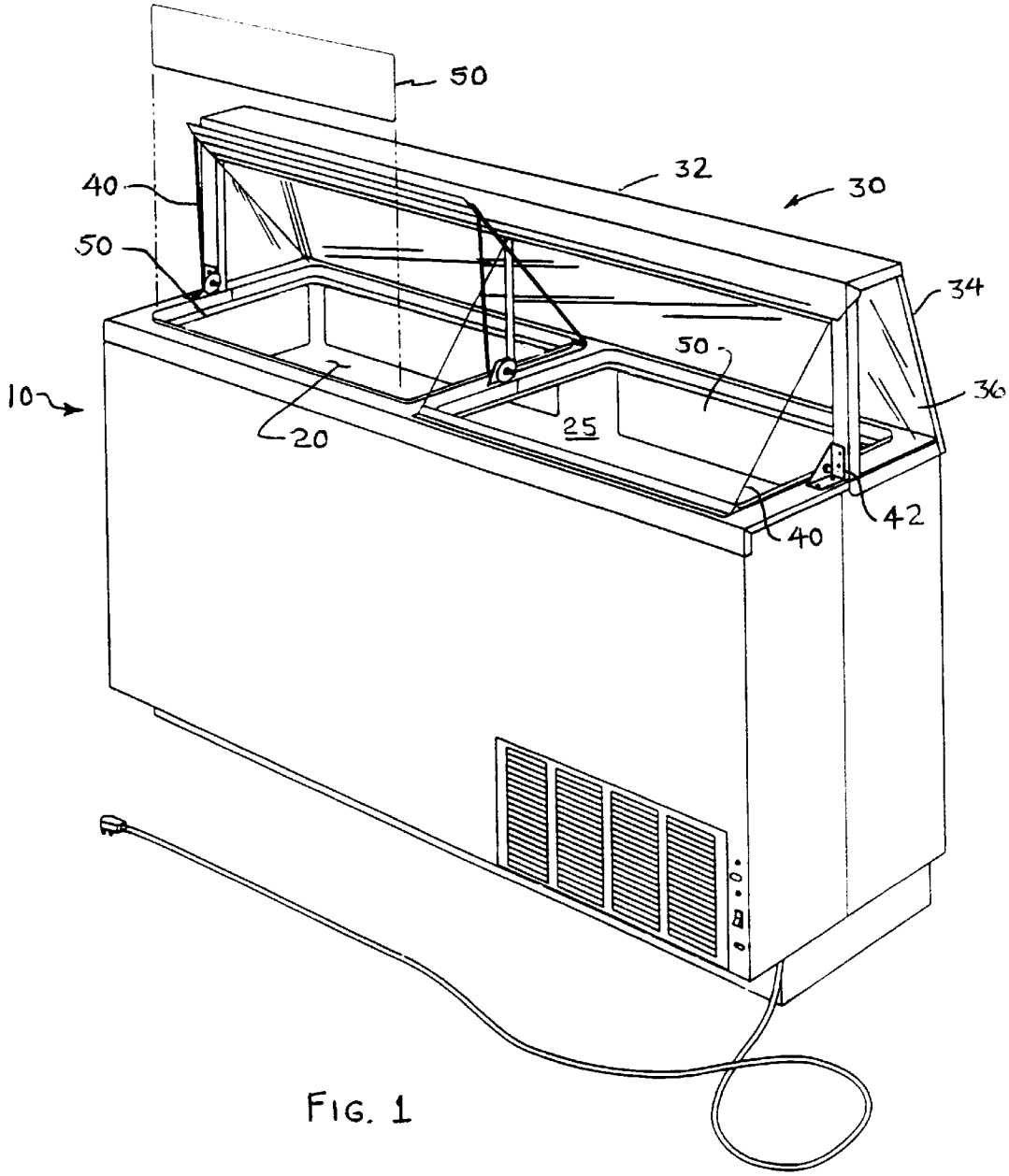
FIG. 1 is a perspective view of a refrigerated cabinet having installed therein a plurality of frost shields in accordance with the present invention.
Figure 3:
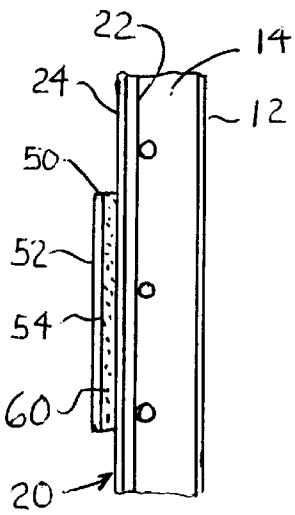
FIG. 3 is a sectional view of the frost shield of the present invention taken along line 3—3 of FIG. 2.
Figure 5:
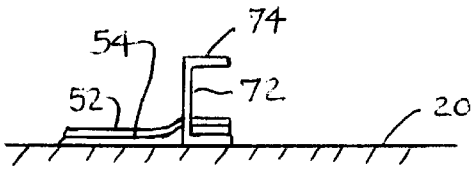
FIG. 5 is a sectional view of the frost shield of the present invention taken along line 5—5 of FIG. 4.
Figure 2:
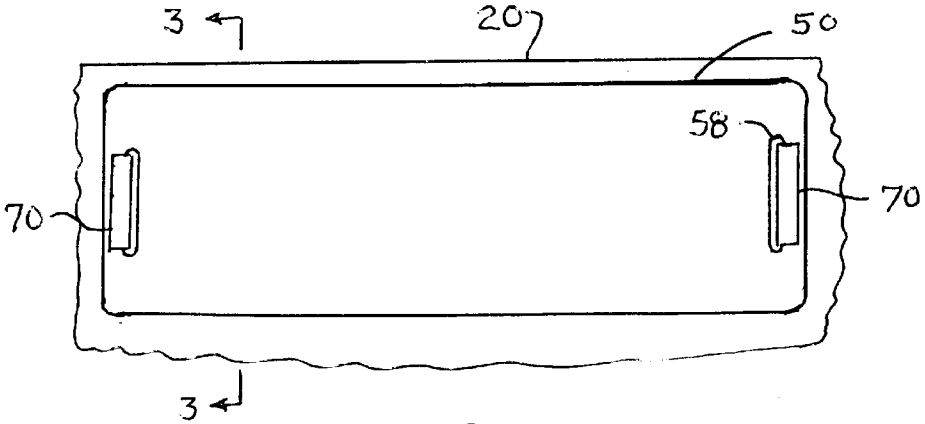
FIG. 2 is a front elevation view of the frost shield of the present invention.
Figure 4:
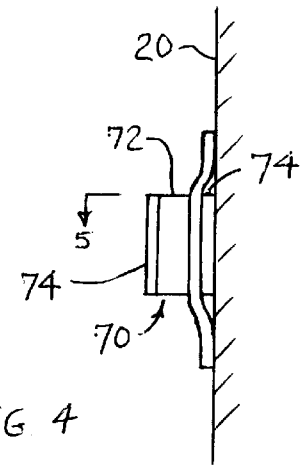
FIG. 4 is a side elevation view, partly in section, of the frost shield of the present invention mounted on the refrigerated liner of the cabinet of FIG. 1.

The frost shield of the present invention will be described herein as applied to an ice cream dipping cabinet. It is to be understood, however, that the frost shield of the present invention is generally applicable to various designs of refrigerated cabinets subject to frost formation on the refrigerated walls thereof and is not limited to the embodiments illustrated in the drawing.

Referring now to FIG. 1, there is depicted therein a refrigerated cabinet 10 of type commonly used in commercial establishments as an ice cream dipping cabinet. As depicted, the cabinet 10 includes an outer shell 12 and an interior refrigerated liner 20 comprising a box-like enclosure having four side walls, a floor and an open top. Typically, the side walls and floor of the liner 20 are each formed of a metallic, conventionally stainless steel, support sheet 22 with a vinyl layer 24 coated on the observe side thereof. The liner 20 encloses a refrigerated volume 25 in which refrigerated product is stored. In the case of an ice cream dipping cabinet, the refrigerated product may, for example, constitute hard ice cream, frozen yogurt, sorbet, sherbet or other frozen confection.

The outer shell 12 surrounds the liner 20 in spaced relationship about the four side walls and floor thereof. An insulating material 14, for example a foamed in place polyurethane material, disposed in the space between the outer shell 12 and the liner 20 thermally isolates the refrigerated liner 20 from the outer shell 12, which is exposed to room temperature, and adds structure integrity to the cabinet. The liner 20 is cooled in a conventional manner by means of evaporator tubing 16 mounted to or otherwise disposed in heat exchange relationship with the back surface of the liner 20. The evaporator tubing is part of a conventional refrigeration circuit (not shown) wherein compressed refrigerant from a compressor is expanded via a thermal expansion valve, passed through the evaporator tubing, thence through a condenser before returning to the compressor. As the refrigerant, for example R-22 or other commercially available refrigerant, passes through the evaporator tubing, the refrigerant evaporates upon absorbing heat through the liner 20 from the air within the refrigerated volume 25, thereby cooling the air to maintain a desired temperature.

A canopy 30 mounted to an upper portion of the cabinet 10 covers the refrigerated volume 25. The canopy 30 has a top wall 32, a customer front having a front wall 34 and side walls 36, and at least one service cover 40 on the service side, i.e. the backside, of the canopy. The front wall 34 and, if desired, the side walls 36 also of the front wall are glass or other transparent material so as to permit customer viewing of the product stored within the refrigerated volume. In the depicted embodiment, a pair of service covers 40, each in the form of a triangular half tent-like structure, disposed in side-by-side relationship form the service side of the canopy 30. Each of the service covers 40 is pivotably mounted to the cabinet 10 on brackets 42 so as to rotate forwardly to provide open access to the refrigerated volume 25 for dipping the frozen confection stored therein. As depicted in FIG. 1, the right cover 40 is in the closed position and the left service cover 40 is in the open position for providing access to the refrigerated volume 25. The half tent-like covers 40 are most advantageously formed as a single piece molded, transparent plastic or Plexiglas material. However, the service side of the canopy 30 may simply be in the form of a panel having one or more sliding doors covering access openings therethrough.

As the service covers 40 are frequently opened during the day to serve customers, frost typically forms rather quickly around an upper circumferential expanse of the four walls of the refrigerated liner 20, typically extending several inches down into the refrigerated volume 25. Accordingly, a plurality of frost shields 50 are detachably positioned about the upper circumferential expanse of the four walls of the refrigerated liner 20. In accordance with the present invention, the frost shields 50 are magnetically mountable to the liner 20 to facilitate ease of installation and removal for frost removal and cleaning.

Referring now to FIGS. 2, 3, 4 and 5 in particular, the frost shields 50, in accordance with the present invention, comprise pliable panels fabricated in a layered construction. Each frost shield 50 has a relatively thin observe layer 52 of vinyl mounted on nominally thicker back layer of thermoplastic material 54. This back layer of thermoplastic material is impregnated with magnetic material 60, most advantageously distributed relatively evenly throughout the thermoplastic material layer 54. In a particularly advantageous embodiment, the magnetic material 60 comprises ferrite powder.

To facilitate installation and removal, the frost shield 50 may be provided with a pair of handles 70. Preferably, the handles 70 are formed in a single piece without sharp edges that might mar the vinyl on the frost shield panel or on the liner 20. The handles 70 are also preferably formed of a material that is relatively easily cleaned, such as stainless or thermoplastic material. As depicted, each handle 70 comprises a channel member having a base 72 and legs 74 disposed at the opposite sides of the base 72 to extend along the longitudinal length of the channel. The handles 70 are inserted in their respective slots 58 formed through the frost shield panel. Although depicted as positioned at the longitudinally opposite sides 53 of the panel, the handles 70 may be otherwise positioned relative to the panel, for example at horizontally spaced locations along the upper side of the panel, as desired. The specific location of the handles 70 relative to the panel of the frost shield is not germane to or limiting of the invention.

The frost shields 50 are easily installed by opening the service cover 40, grasping the handles 70 of the frost shield 50, lowering the shield into the refrigerated volume 25 through the access door provided by the open service cover 40 and simply laying the pliable panel 55 up against the liner 20 at the desired location. The panel 55 being pliable, the frost shield conforms to the contour of the surface of the refrigerated liner 20 and adheres thereto via magnetic attraction between the magnetic material associated with the frost shield 50 and the support sheet 22 underlying the vinyl surface coating 24. For defrosting, with the service door 40 open, the frost shields 50 are easily removed by grasping the handles 70 thereof, pulling the panel 55 away from the surface of liner 20 and lifting the frost shield out of the cabinet 10 through the service access opening provided by the open service cover 40. The frost are then exposed to hot water to remove the frost accumulated thereon and then washed before being reinstalled in the refrigerated cabinet 10.

Various modifications and adaptations of the embodiments of the present invention as herein before described may be readily apparent to those skilled in the art that may be made without departure from the spirit and scope of the present invention, the scope of which is defined in the appended claims.

What is claimed is:

1. A detachable frost shield for a refrigerated cabinet comprising a substantially planar panel of pliable material impregnated with a magnetic material for adhering the frost shield to the refrigerated cabinet via magnetic attraction.

2. A frost shield as recited in claim 1 wherein said magnetic material comprises ferrite powder.

3. A detachable frost shield for a refrigerated cabinet comprising a substantially planar pliable panel including a finish layer mounted to a base layer of vinyl material mounted to a layer of pliable material having a magnetic material associated therewith for adhering the frost shield to the refrigerated cabinet via magnetic attraction.

4. A frost shield as recited in claim 3 wherein said pliable material comprises a thermoplastic material.

5. A frost shield as recited in claim 4 wherein said magnetic material is impregnated into the layer of pliable thermoplastic material.

6. A frost shield as recited in claim 5 wherein said magnetic material comprises ferrite powder.

* * * * *